US011939893B2

(12) United States Patent
Schrattenberger

(10) Patent No.: US 11,939,893 B2
(45) Date of Patent: Mar. 26, 2024

(54) CYLINDER CRANKCASE HAVING AT LEAST ONE RISER DUCT AND INTERNAL COMBUSTION ENGINE COMPRISING A CYLINDER CRANKCASE

(71) Applicant: Bayerische Motoren Werke Aktiengesellschaft, Munich (DE)

(72) Inventor: Andreas Schrattenberger, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 17/919,049

(22) PCT Filed: May 3, 2021

(86) PCT No.: PCT/EP2021/061515
§ 371 (c)(1),
(2) Date: Oct. 14, 2022

(87) PCT Pub. No.: WO2021/244809
PCT Pub. Date: Dec. 9, 2021

(65) Prior Publication Data

US 2023/0235688 A1 Jul. 27, 2023

(30) Foreign Application Priority Data

Jun. 3, 2020 (DE) ..... 10 2020 114 716.3

(51) Int. Cl.
*F01M 11/02* (2006.01)

(52) U.S. Cl.
CPC ..... *F01M 11/02* (2013.01)

(58) Field of Classification Search
CPC ..... F01M 11/02
USPC ..... 123/196 R, 196 CP, 196 M
See application file for complete search history.

(56) References Cited

U.S. PATENT DOCUMENTS 5,507,259 A 4/1996 Tanaka
8,033,258 B2 * 10/2011 Yi ..... F01L 1/34 123/90.31
2010/0024751 A1 2/2010 Yi

FOREIGN PATENT DOCUMENTS

| | | | |
|---|---|---|---|
| CN | 101639002 | A | 2/2010 |
| DE | 44 28 681 | A1 | 4/1995 |
| DE | 102 16 329 | A1 | 11/2003 |
| DE | 103 28 164 | A1 | 1/2005 |
| EP | 1 052 394 | A2 | 11/2000 |
| JP | 56-110506 | A | 9/1981 |

(Continued)

OTHER PUBLICATIONS

International Search Report (PCT/ISA/210) issued in PCT Application No. PCT/EP2021/061515 dated Aug. 10, 2021 with English translation (five (5) pages).

(Continued)

*Primary Examiner* — Hai H Huynh
(74) *Attorney, Agent, or Firm* — Crowell & Moring LLP

(57) ABSTRACT

A cylinder crankcase for an internal combustion engine includes at least one riser duct. The cylinder crankcase comprises at least one additional riser duct, which is configured to exchange oil between the main oil gallery and the cylinder head. The cylinder crankcase also comprises a connecting duct, via which the at least one riser duct and the at least one additional riser duct are connected in an oil-conducting fashion.

10 Claims, 2 Drawing Sheets

(56) References Cited

FOREIGN PATENT DOCUMENTS

| | | | |
|---|---|---|---|
| JP | 1-134019 | A | 5/1989 |
| JP | 3-286113 | A | 12/1991 |
| JP | 2016-44571 | A | 4/2016 |

OTHER PUBLICATIONS

German-language Written Opinion (PCT/ISA/237) issued in PCT Application No. PCT/EP2021/061515 dated Aug. 10, 2021 (four (4) pages).
German-language Search Report issued in German Application No. 10 2020 114 716.3 dated Dec. 28, 2020 with partial English translation (11 pages).
Chinese-language Office Action issued in Chinese Application No. 202180027744.0 dated Sep. 19, 2023 with English translation (17 pages).

* cited by examiner

CYLINDER CRANKCASE HAVING AT LEAST ONE RISER DUCT AND INTERNAL COMBUSTION ENGINE COMPRISING A CYLINDER CRANKCASE

BACKGROUND

The disclosure relates to a cylinder crankcase for an internal combustion engine, having at least one riser duct which is configured for the exchange of oil between a main oil gallery of the cylinder crankcase and a cylinder head of the internal combustion engine. A further aspect of the disclosure relates to an internal combustion engine having such a cylinder crankcase.

Various components, such as a valve drive or a hydraulic chain tensioner, can be supplied with oil via the riser duct of such a cylinder crankcase, whereby the operational reliability of these components can be permanently ensured.

EP 1 052 394 A2 closes a liquid-cooled, multi-cylinder internal combustion engine having a cylinder head arranged detachably on the cylinder crankcase, comprising respective coolant chambers in the crankcase and cylinder head. The coolant chamber is, in the cylinder head, delimited by the outer walls thereof, by a bottom plate at the crankcase side, and by a top wall arranged spaced apart above the bottom plate, and is divided by means of transverse walls into sections assigned to a respective cylinder-associated combustion chamber. The coolant which flows transversely through the cylinder head in the sections and which washes around gas exchange ducts and receptacles for ignition plugs and/or injection nozzles flows in the direction of the cylinder crankcase via apertures arranged in the bottom plate adjacent to a longitudinal side of the cylinder head. The cylinder crankcase comprises a coolant chamber that is divided into subregions. A device arranged in the cylinder crankcase serves for conducting the coolant that flows out of the cylinder head onward to a riser duct that is integrated in the cylinder head. A ventilation line is furthermore provided which, in the cylinder head, connects the sections of these coolant chambers at high points and which opens into the riser duct, which is connectable to an external line connector, in a region of a geodetic highest point.

SUMMARY

One of the objects of the present disclosure to create a cylinder crankcase of the type mentioned in the introduction, by means of which a particularly reliable supply of oil to respective components of the internal combustion engine can be ensured.

This and other objects are achieved by means of a cylinder crankcase having the features of this disclosure. A first aspect of the disclosure relates to a cylinder crankcase for an internal combustion engine, having at least one riser duct which is configured for the exchange of oil between a main oil gallery of the cylinder crankcase and a cylinder head of the internal combustion engine. Here, the expression "riser duct" is to be understood to mean that, during the intended use of the cylinder crankcase, oil can be guided through this riser duct to the cylinder head counter to gravitational force.

According to the disclosure, provision is made for the cylinder crankcase to comprise at least one additional riser duct, which is configured for the exchange of oil between the main oil gallery and the cylinder head, and a connecting duct, by means of which the at least one riser duct and the at least one additional riser duct are connected in oil-conducting fashion. This is advantageous because, in this way, at least two riser ducts, specifically the riser duct and the additional riser duct, can be supplied with oil via the connecting duct, and it is also possible for oil to be delivered to mutually different components of the internal combustion engine via these mutually different riser ducts (riser duct, additional riser duct), wherein respective transfer points between the respective riser ducts and the cylinder head can—by contrast to oil-guiding grooves on a cylinder head underside—be sealed off with particularly little outlay and in particularly reliable fashion by means of a cylinder head seal of the internal combustion engine. The components may for example be an inlet-side valve drive, an outlet-side valve drive and additionally or alternatively a hydraulic chain tensioner or further outlet-side consumers of the internal combustion engine. The riser ducts thus allow targeted guidance of oil to the respective components, wherein a respective one of the riser ducts may be provided for each of the components.

It is preferably possible for the direct exchange of oil between the main oil gallery and the cylinder head to take place via the at least one riser duct. It is likewise preferably possible for the direct exchange of oil between the main oil gallery and the cylinder head to take place via the at least one additional riser duct. It is thus achieved that the oil is guided from the main oil gallery to the cylinder head with particularly low losses. The expression "directly" is to be understood in the context of the disclosure to mean that the riser duct or the additional riser duct respectively can connect the main oil gallery to the cylinder head directly, that is to say in particular without the interposition of further ducts. In this way, the oil from the main oil gallery can directly enter the riser duct or the additional riser duct respectively and be guided to the cylinder head via the riser duct or the additional riser duct respectively.

The disclosure is based on the realization that an existing oil-guiding groove, in particular on the underside of the cylinder head, is firstly sealed off over a long sealing length and thus with increased outlay, wherein a sealing bead runs in complex fashion around the groove in order that it can be ensured that no leakage occurs as oil is guided via the groove from an inlet side to an outlet side. Furthermore, such a groove weakens the cylinder head, resulting in losses in the load capacity of the cylinder head. The disclosure addresses this, because the riser ducts can firstly be sealed off particularly easily and secondly allow particularly targeted guidance of the oil to the respective components. Furthermore, weakening of the cylinder head can be omitted, especially since the groove can be omitted.

In one advantageous refinement of the disclosure, the at least one riser duct and the at least one additional riser duct are oriented at least substantially parallel to one another. This is advantageous because the riser duct and the additional riser duct can thus be produced particularly easily and, in particular, particularly structural-space-saving transport of the oil counter to gravitational force is made possible via the respective riser ducts. Here, the expression "substantially parallel" is to be understood to mean that respective central axes of the riser duct and of the additional riser duct either run parallel to one another or enclose an acute angle of for example less than or equal to 10° with one another.

In a further advantageous refinement of the disclosure, the at least one riser duct and/or the at least one additional riser duct opens into the connecting duct. This is advantageous because, in this way, it is made possible for the oil to pass over directly and with low losses from the connecting duct into the riser duct and additionally or alternatively into the additional riser duct. By virtue of the fact that the riser duct and/or the additional riser duct opens into the connecting duct, the riser duct and/or the additional riser duct can end, so to speak, at the connecting duct.

In a further advantageous refinement of the disclosure, the at least one riser duct and/or the at least one additional riser duct ends at a top surface of the cylinder crankcase, which top surface faces toward the cylinder crankcase during the intended use of the cylinder crankcase and of the cylinder head. This is advantageous because the riser duct and additionally or alternatively the additional riser duct thus end directly adjacent to the cylinder head during the intended use of the cylinder crankcase, whereby particularly direct guidance of the oil via the respective riser ducts to the cylinder head is made possible. Preferably, the riser duct and/or the at least one additional riser duct may have an at least substantially circular cross section at least at the top surface. The at least substantially circular cross section may also be understood to mean an ellipse-shaped cross section, wherein respective semi-axes of this ellipse may have a size ratio for example 3 to 1 or less.

In a further advantageous refinement of the disclosure, the at least one riser duct is arranged at a first side of the cylinder crankcase, and the at least one additional riser duct is arranged at a second side, situated opposite the first side, of the cylinder crankcase. This is advantageous because a particularly targeted distribution of the oil over a particularly large region of the cylinder crankcase is made possible in this way. The first side and the second side may be situated opposite one another in a transverse extent direction of the cylinder crankcase. In other words, the first side and the second side may be situated opposite one another perpendicularly with respect to a longitudinal extent direction of the cylinder crankcase. The first side may also be configured as a first half, and the second side as a second half, of the cylinder crankcase. In other words, the respective sides may thus be respective halves of the cylinder crankcase.

In a further advantageous refinement of the disclosure, the first side is configured as an inlet side, and the second side is configured as an outlet side. This is advantageous because, in this way, particularly direct lubrication of components of the internal combustion engine arranged on the inlet side and on the outlet side and on the cylinder head is made possible without complex oil guidance. For example, an inlet-side valve drive may be arranged, and supplied with oil, on the inlet side, and, for example, an outlet-side valve drive of the internal combustion engine may be arranged, and supplied with oil, on the outlet side.

In a further advantageous refinement of the disclosure, the connecting duct passes through an outer wall of the cylinder crankcase on the first side. This is advantageous because, in this way, it is firstly possible for the connecting duct to be produced particularly easily, and it is secondly made possible for the oil to be introduced through the outer wall to the respective riser ducts with particularly low losses.

In a further advantageous refinement of the disclosure, an escape of oil via the connecting duct is prevented on the second side. This is advantageous because, in this way, a particularly high pressure can be generated within the connecting duct and transmitted to the respective riser ducts, whereby a particularly effective supply of oil via the riser ducts is made possible. The prevention of the escape of oil can be achieved by virtue of the connecting duct ending on the second side within the cylinder crankcase, or being closed on the second side by means of a closure element, for example.

In a further advantageous refinement of the disclosure, the connecting duct is closed on the first side and/or on the second side with respect to surroundings of the cylinder crankcase by way of a plug or by way of a sensor. It is advantageous here that the connecting duct can thus be configured as a passage duct and can thus be produced particularly easily and can be easily closed by way of the plug or sensor. The sensor may be configured as an oil pressure sensor and/or as a temperature sensor.

A second aspect of the disclosure relates to an internal combustion engine having a cylinder crankcase according to the first aspect of the disclosure. In this internal combustion engine, a particularly reliable supply of oil to respective components of the internal combustion engine is made possible.

The preferred embodiments presented with regard to one of the aspects, and the advantages of said embodiments, apply correspondingly to the respective other aspects of the disclosure, and vice versa.

The features and feature combinations mentioned above in the description, and the features and feature combinations mentioned below in the description of the figures and/or shown only in the figures, may be used not only in the respectively specified combination but also in other combinations, or individually, without departing from the scope of the disclosure.

Further advantages, features and details of the disclosure will emerge from the claims, from the following description of preferred embodiments, and from the drawings.

The disclosure will be discussed once again below on the basis of a specific exemplary embodiment. In the drawings:

DETAILED DESCRIPTION

Figure 1:
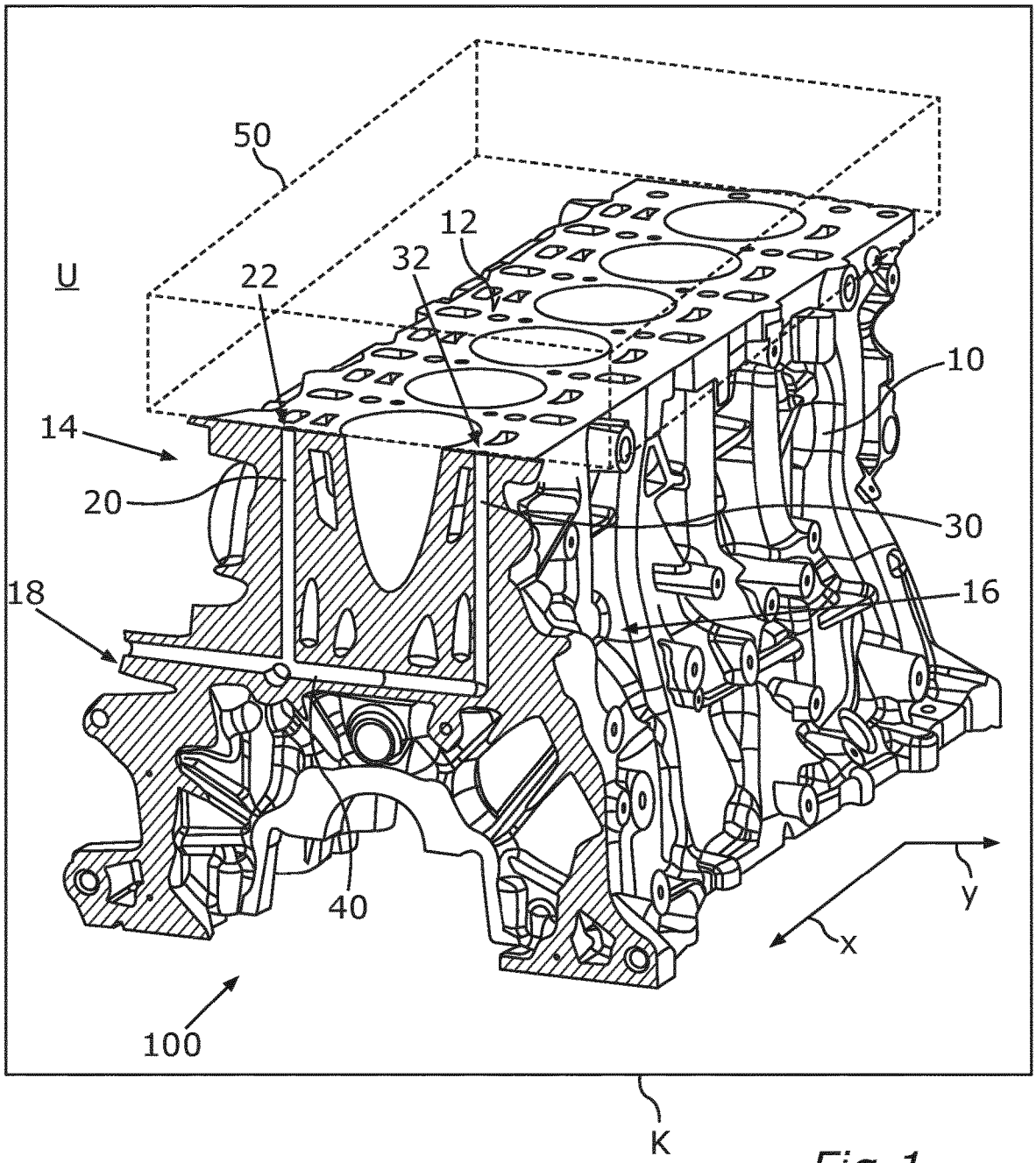
FIG. 1 shows a schematic perspective view of a subregion, illustrated partially in section, of an internal combustion engine which comprises a cylinder crankcase and a cylinder head that is connected in oil-tight fashion to the cylinder crankcase at a top surface of the cylinder crankcase, wherein the cylinder crankcase comprises a riser duct and an additional riser duct which are configured for the exchange of oil between a main oil gallery of the cylinder crankcase and the cylinder head and which are connected to one another via a connecting duct.
Figure 2:
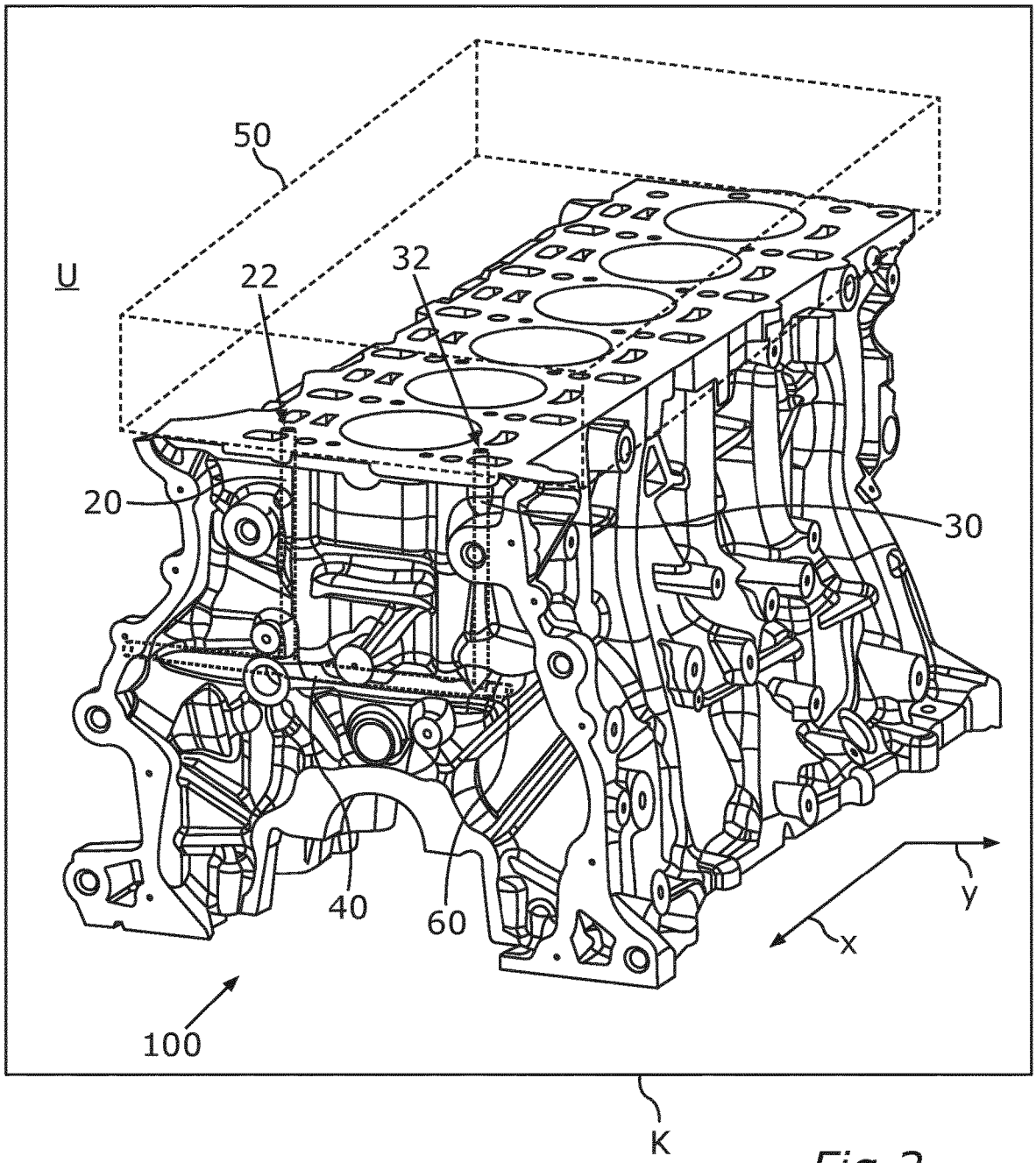
FIG. 2 shows a further schematic perspective view of the subregion of the internal combustion engine.

FIG. 1 and FIG. 2 show, in each case in a schematic illustration, respective subregions of an internal combustion engine 100 having a cylinder crankcase 10 and having a cylinder head 50. The internal combustion engine 100 is in this case arranged in a motor vehicle K and serves for the propulsion thereof. In other words, the motor vehicle K comprises the internal combustion engine 100.

During the intended use of the cylinder head 50 and of the cylinder crankcase 10, the cylinder head 50 is arranged sealingly on a top surface 12 of the cylinder crankcase 10 and/or is in contact with and screwed to the cylinder crankcase 10. A cylinder head seal (not shown in any more detail here) of the internal combustion engine 100 serves for the sealing between the cylinder head 50 and the cylinder crankcase 10.

The cylinder crankcase 10 comprises a riser duct 20, which is configured for the exchange of oil between a main oil gallery (not shown in any more detail here) of the cylinder crankcase 10 and the cylinder head 50.

Furthermore, the cylinder crankcase 10 comprises an additional riser duct 30, which is likewise configured for the exchange of oil between the main oil gallery and the cylinder head 50. The cylinder crankcase 10 furthermore comprises a connecting duct 40, by means of which the riser duct 20 and the additional riser duct 30 are connected in oil-conducting fashion. The riser duct 20 and the additional riser duct 30 are in the present case oriented parallel to one another.

The riser duct 20 and the additional riser duct 30 are in this case oriented parallel to the direction of gravitational force, that is to say in other words parallel to a direction in which gravitational force acts. Accordingly, in the present case, a respective central axis of the respective riser ducts 20, 30 runs parallel to the direction of gravitational force.

In the present case, the riser duct 20 and the additional riser duct 30 open directly into the connecting duct 40.

The riser duct 20 and the additional riser duct 30 furthermore end at the top surface 12 of the cylinder crankcase 10, which top surface faces toward the cylinder crankcase 10 during the intended use of the cylinder crankcase 10 and of the cylinder head 50. The riser duct 20 has a transfer point 22 which is configured as an opening of circular or elliptical cross section and via which the oil can be conducted to components, in particular components arranged at an inlet side, which may be arranged on the cylinder head 50. By contrast, the additional riser duct 30 has a transfer point 32 which is configured as an opening of circular or elliptical cross section and via which the oil can be conducted to further components, in particular components arranged at an outlet side, which may be arranged on the cylinder head 50. In the present case, the transfer points 22, 32 are configured as circular openings and can thus be sealed off particularly easily by means of the cylinder head seal in order to prevent an undesired escape of oil (leakage) to surroundings U of the cylinder crankcase 10 and thus of the internal combustion engine 100.

It can furthermore be seen from FIG. 1 and FIG. 2 that the connecting duct 40 is oriented in a transverse extent direction y, indicated by an arrow, of the cylinder crankcase 10. Accordingly, the connecting duct 40 is oriented perpendicular to a longitudinal extent direction x, illustrated by a further arrow, of the cylinder crankcase 10. Furthermore, FIG. 1 and FIG. 2 show that, in a transverse extent direction y, the riser duct 20 and the additional riser duct 30 have a spacing greater than a respective diameter of respective cylinder bores arranged on the cylinder crankcase 10. In this way, any structural weakening of the cylinder crankcase 10 in the region of the cylinder bores as a result of the riser ducts 20, 30 can be kept particularly minor.

The riser duct 20 is arranged at a first side 14, configured as an inlet side, of the cylinder crankcase 10, whereas the additional riser duct 30 is arranged at a second side 16, situated opposite the first side 14 in a transverse extent direction y and configured as an outlet side, of the cylinder crankcase 10. Here, the "inlet side" corresponds to the side at which gas exchange valves of the internal combustion engine 100 that are configured as respective inlet valves are arranged, whereas the "outlet side" corresponds to the side at which gas exchange valves of the internal combustion engine 100 that are configured as respective outlet valves are arranged. By means of the gas exchange valves, a charge exchange can be performed at respective combustion chambers of the internal combustion engine 100, that is to say, in other words, fresh air and exhaust gas can be intermittently supplied to the respective combustion chambers and discharged from the respective combustion chambers respectively.

The connecting duct 40 passes through an outer wall 18 of the cylinder crankcase 10 on the first side 14. An escape of oil via the connecting duct 40 to the surroundings U of the cylinder crankcase 10 and of the internal combustion engine 100 is prevented on the first side 14, and additionally or alternatively on the second side 16, by virtue of the connecting duct 40 being closed on the first side 14 and additionally or alternatively on the second side 16 with respect to the surroundings U by way of a respective closure element 60, which may be configured for example as a plug or as a sensor, in particular oil pressure sensor.

In the present cylinder crankcase 10, the connecting duct 40 is configured as a transverse bore which runs in a transverse extent direction y and which may be configured in particular as a blind bore and which extends at least from the riser duct 20, which is connected to a main oil duct of the internal combustion engine 100, at least to the additional riser duct 30. The connecting duct 40 (transverse bore) supplies oil to the additional riser duct 30, which may also be referred to as the second riser duct, within the cylinder crankcase 10, wherein the oil can be guided to the cylinder head 50 counter to gravitational force both by way of the riser duct 20 and by way of the additional riser duct 30. By means of the two riser ducts 20, 30, which in the present case are parallel, it is possible to realize a separate supply of oil to an inlet-side valve drive, an outlet-side valve drive and a hydraulic chain tensioner of the internal combustion engine 100, or possibly further outlet-side consumers of the internal combustion engine 100. The transfer points 22, 32 between the cylinder crankcase 10 and the cylinder head 50 are in the present case configured as circular openings and can thus be particularly easily sealed off by means of the cylinder head seal.

LIST OF REFERENCE DESIGNATIONS

10 Cylinder crankcase
12 Top surface
14 First side
16 Second side
18 Outer wall
20 Riser duct
22 Transfer point
30 Additional riser duct
32 Transfer point
40 Connecting duct
50 Cylinder head
60 Closure element
100 Internal combustion engine
K Motor vehicle
U Surroundings
x Longitudinal extent direction
y Transverse extent direction

The invention claimed is:

1. A cylinder crankcase for an internal combustion engine comprising:

at least one riser duct which is configured to exchange oil directly and without additional intervening ducts between a main oil gallery of the cylinder crankcase and a cylinder head of the internal combustion engine, wherein the cylinder crankcase comprises at least one additional riser duct, which is configured to exchange oil directly and without additional intervening ducts between the main oil gallery and the cylinder head, and a connecting duct, via which the at least one riser duct and the at least one additional riser duct are connected in an oil-conducting fashion.

2. The cylinder crankcase according to claim 1, wherein the at least one riser duct and the at least one additional riser duct are oriented at least parallel to one another.

3. The cylinder crankcase according to claim 2, wherein the at least one riser duct and/or the at least one additional riser duct opens into the connecting duct.

4. The cylinder crankcase according to claim 3, wherein the at least one riser duct and/or the at least one additional riser duct ends at a top surface of the cylinder crankcase, which top surface faces toward the cylinder crankcase during the intended use of the cylinder crankcase and of the cylinder head.

5. The cylinder crankcase according to claim 4, wherein the at least one riser duct is arranged at a first side of the cylinder crankcase, and the at least one additional riser duct is arranged at a second side, situated opposite the first side, of the cylinder crankcase.

6. The cylinder crankcase according to claim 5, wherein the first side is configured as an inlet side, and the second side is configured as an outlet side.

7. The cylinder crankcase according to claim 5, wherein the connecting duct passes through an outer wall of the cylinder crankcase on the first side.

8. The cylinder crankcase according to claim 7, wherein an escape of oil via the connecting duct is prevented on the second side.

9. The cylinder crankcase according to claim 8, wherein the connecting duct is closed on the first side and/or on the second side with respect to surroundings of the cylinder crankcase via a plug or a sensor.

10. An internal combustion engine comprising:
the cylinder crankcase according to claim 9.

* * * * *